US006743993B1

(12) United States Patent
Clark et al.

(10) Patent No.: US 6,743,993 B1
(45) Date of Patent: Jun. 1, 2004

(54) BACKLIT FULL TRAVEL KEY ASSEMBLY

(75) Inventors: James T. Clark, Spokane, WA (US); Aaron D. Johnson, Colfax, WA (US)

(73) Assignee: Advanced Input Devices, Inc., C'oeur d'Alene, ID (US)

( * ) Notice: Subject to any disclaimer, the term of this patent is extended or adjusted under 35 U.S.C. 154(b) by 71 days.

(21) Appl. No.: 10/082,806

(22) Filed: Feb. 21, 2002

(51) Int. Cl.[7] ..... H01H 9/00
(52) U.S. Cl. ..... 200/314
(58) Field of Search ..... 200/5 R, 512, 200/517, 310–317, 341–345, 5 A

(56) References Cited

U.S. PATENT DOCUMENTS

| | | | | | |
|---|---|---|---|---|---|
| 4,078,257 | A | * | 3/1978 | Bagley | 708/145 |
| 4,439,646 | A | | 3/1984 | Bouvrande | 200/5 A |
| 4,489,227 | A | | 12/1984 | Lamarche | 200/314 |
| 4,551,598 | A | * | 11/1985 | Hamilton et al. | 200/314 |
| 4,939,324 | A | * | 7/1990 | English et al. | 200/345 |
| 5,278,371 | A | | 1/1994 | Watanabe et al. | 200/344 |
| 5,280,145 | A | | 1/1994 | Mosier et al. | 200/313 |
| 5,406,277 | A | * | 4/1995 | Lee | 341/22 |
| 5,432,684 | A | | 7/1995 | Fye et al. | 362/30 |
| 5,466,901 | A | | 11/1995 | Mochizuki | 200/5 A |
| 5,510,782 | A | | 4/1996 | Norris et al. | 341/22 |
| 5,612,692 | A | | 3/1997 | Dugas et al. | 341/22 |
| 5,793,605 | A | | 8/1998 | Sellers | 361/680 |
| 5,794,762 | A | * | 8/1998 | Tsai | 200/345 |
| 5,828,015 | A | | 10/1998 | Coulon | 200/5 A |
| 6,545,232 | B1 | * | 4/2003 | Huo-Lu | 200/5 A |

* cited by examiner

*Primary Examiner*—Michael A. Friedhofer
(74) *Attorney, Agent, or Firm*—Christensen O'Connor Johnson Kindness PLLC

(57) ABSTRACT

A key assembly including a key support structure, a switch, a base, and a moveable key. A light source, such as an LED, is mounted to the base to provide illumination for backlighting a translucent region disposed in the moveable key. In operation, when pressure is exerted against the moveable key, the moveable key axially translates to operate the switch. When the moveable key is in its at-rest position, light from the light source will be efficiently and uniformly dispersed through the key assembly to backlight the translucent region based on the location of said light source.

48 Claims, 6 Drawing Sheets

BACKLIT FULL TRAVEL KEY ASSEMBLY

FIELD OF THE INVENTION

The present invention relates generally to switch actuators for use in keyboards and the like, and more particularly to movable keys having a backlighting function.

BACKGROUND OF THE INVENTION

Generally described, a wide variety of keyboards are utilized for data entry terminals and remote control terminals. Typically, the keys of the keyboards correspond to a particular numeral or operation. Often these keys are complex in construction and operate not only to make switch contact, but to provide an operator with a tactile sensation or feedback, whereby the operator is assured of having made switch contact. Such switches employ a wide variety of structures ranging from spring loaded assemblies to dome-type switch elements to provide this tactile feedback signal.

Many of such keyboards also provide backlighting of the individual keys, so that the keyboard may be used at certain times, for example, to indicate when the key has been properly depressed, to indicate the status of a function controllable by the key, or in a darkened environment. Commonly, backlighting is provided by a plurality of light emitting diodes ("LEDs") associated with each of the keys. However, the use of LEDs as the source of illumination has led to many deficiencies in the prior art. For example, the placement of the LEDs within the keys or the number of LEDs utilized to illuminate each key has caused significant problems, such as intensely illuminated areas and non-uniform illumination, i.e. hot spots, which are unacceptable in modern backlighted keys. Additionally, the number of LEDs utilized to illuminate each key has caused greater energy consumption by each key, which is again unacceptable in modern backlighted keys.

SUMMARY OF THE INVENTION

The present invention is directed to a key assembly having a backlighting function that provides a more uniform illumination of the keys, reduces the presence of hotspots, and lowers the energy consumption of the key.

In accordance with aspects of the present invention, a backlit key assembly is provided. The key assembly includes a key having a light translucent region. The key is axially movable along a longitudinal axis of the assembly. The key assembly also includes a base and a key support structure operably connected to the base. The key support structure is operable to guide the key when the key is axially movable along the longitudinal axis of the assembly. A switch operable to generate a signal corresponding to the axial movement of the key is provided. The switch includes an opaque member. The key assembly further includes an illumination source mounted to the base in substantial alignment with the opaque member. The illumination source is operable to provide light for backlighting the key assembly through the light translucent region.

In accordance with another aspect of the present invention, a backlit key assembly is provided. The key assembly includes a key having a proximal surface and a distal surface with a translucent region. The key is movable between a non-depressed position and a depressed position along a longitudinal axis of the key assembly. The key assembly also includes a base and a key support structure operably connected to the base. The key support structure is operable to support the key between the non-depressed and depressed positions along the longitudinal axis of the key assembly. A switch disposed adjacent to the base is also provided and is operable to generate a signal when the key is moved proximally to the depressed position. An opaque portion of the switch is in substantial alignment with the translucent region. The key assembly further includes a light source coupled to the base in substantial alignment with the opaque portion, wherein the key assembly is operable to permit light from the light source to pass through the translucent region.

In accordance with still another aspect of the present invention, a backlit key assembly is provided. The key assembly includes a key having a light translucent region. The key is movable between a non-depressed position and a depressed position. The key assembly also includes a circuit board and a key support structure operably connected to the circuit board. The key support structure slideably receives the key. An actuation layer is provided that includes a depressible member that extends outwardly from the actuation layer. The depressible member includes a first electrical contact. The key assembly further includes a switch layer disposed between the actuation layer and the circuit board. The switch layer includes a second electrical contact in overlapping alignment with the first electrical contact. An illumination source is mounted to the circuit board in substantial alignment with the first and second electrical contacts. The illumination source is operable to provide light for backlighting the key assembly through the light translucent region. The first electrical contact contacts the second electrical contact when the key is movable to the depressed position, thereby generating a signal.

In accordance with yet another aspect of the present invention, a backlit key assembly is provided. The key assembly includes a key having a top surface with a light translucent region. The key is movable between a first and a second position when an axial force is exerted on the top surface. The key assembly also includes a base and a key support structure operably connected to the base. The key support structure is operable to support the key between the first and second positions. A switch disposed adjacent to the base is further provided and is operable to generate a signal when the key is in the second position. The switch includes an electrical contact. The key assembly further includes a light source mounted to the base in substantial alignment with the electrical contact and a depressible member disposed adjacent to the switch. The depressible member is operable to maintain the key in the first position when the axial force is not exerted on the top surface of the key, and operable to return the key to the first position from the second position when the force is removed from the top surface of the key.

In accordance with still yet another aspect of the present invention, a backlit key assembly is provided. The key assembly includes a key having a light translucent region. The key is movable between a non-depressed position and a depressed position along a longitudinal axis of the assembly. The key assembly includes a base and a key support structure operable to support the key and adapted to connect the key to the base. A switch is provided that overlays the base and operable to generate a signal. The switch includes an electrical contact. The key assembly further includes an actuator disposed adjacent to the key and extending parallel to the longitudinal axis. The actuator operable to engage the switch when the key is in the depressed position. An illumination source is mounted to the base in substantial alignment with the electrical contact. The illumination source is operable to provide light for backlighting the key assembly through the light translucent region.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
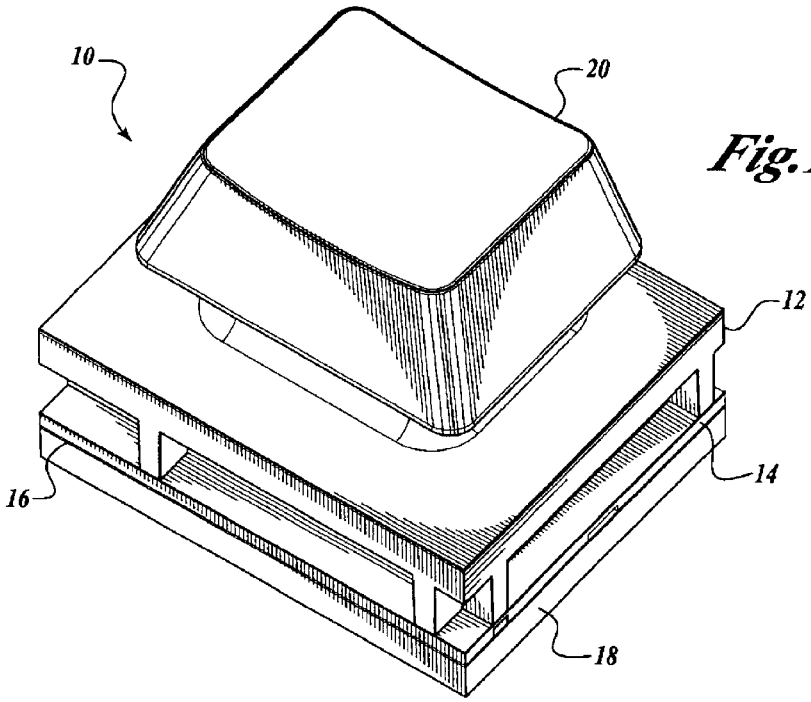
FIG. 1 illustrates a top perspective view of a key assembly constructed in accordance with the present invention.
Figure 2:
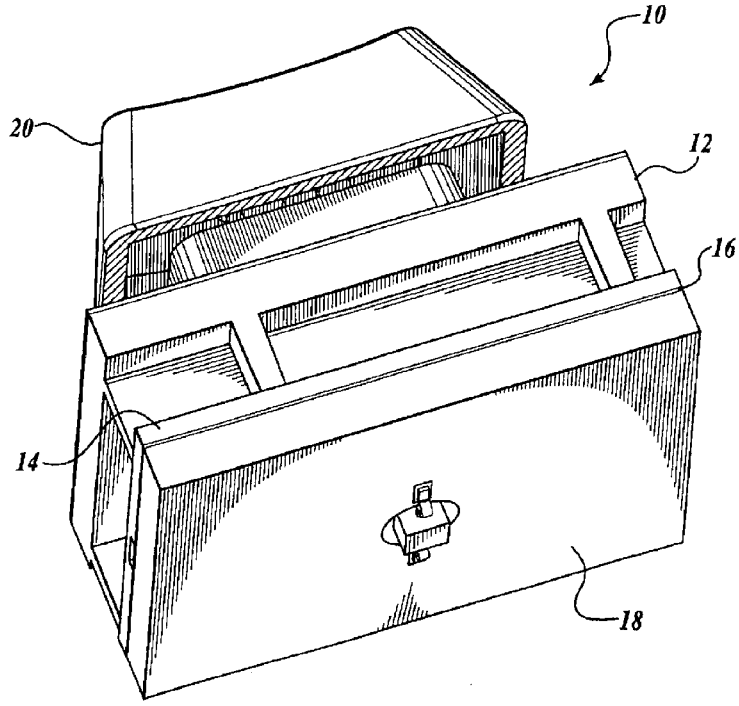
FIG. 2 illustrates a bottom perspective view of the key assembly of FIG. 1.

The present invention will now be described with reference to the accompanying drawings where like numerals correspond to like elements. One suitable embodiment of a key assembly, generally designated 10, constructed in accordance with the present invention is illustrated in FIGS. 1 and 2. A plurality of key assemblies 10 may be aggregated together to form a keyboard which can be used with any conventional system, such as a computer, word processor, calculator, data entry terminal, control panel and the like. For clarity in the following. description, directional terms such as vertical, horizontal, downwardly, upwardly, etc. have been used to describe one suitable embodiment of the key assembly 10 shown in FIGS. 1 and 2 mounted on a horizontal plane and extending away from the plane in an upward manner. However, it will be appreciated that the key assembly 10 of the present invention may be mounted in any orientation, and thus the directional terms will change accordingly.

The key assembly 10 illustrated in FIGS. 1 and 2 includes a key support structure 12, an actuation layer 14, a switch layer 16, a base 18, and a moveable key 20. A light source, such as an LED, is included in the key assembly 10 to provide illumination for backlighting a translucent region in the moveable key 20. In operation, when pressure is exerted against the moveable key 20, the moveable key 20 axially translates toward the base 18, which in turn, depresses a portion of the actuation layer 14 into engagement with the switch layer 16 to operate a switch. During axial translation of the moveable key 20, the key support structure 12 supports the movable key 20 and guides the key along the longitudinal axis of the assembly 10. Once force is relieved from the moveable key 20, the actuation layer 14 returns the moveable key 20 to the first or non-depressed position shown in FIG. 4A.

Figure 3:
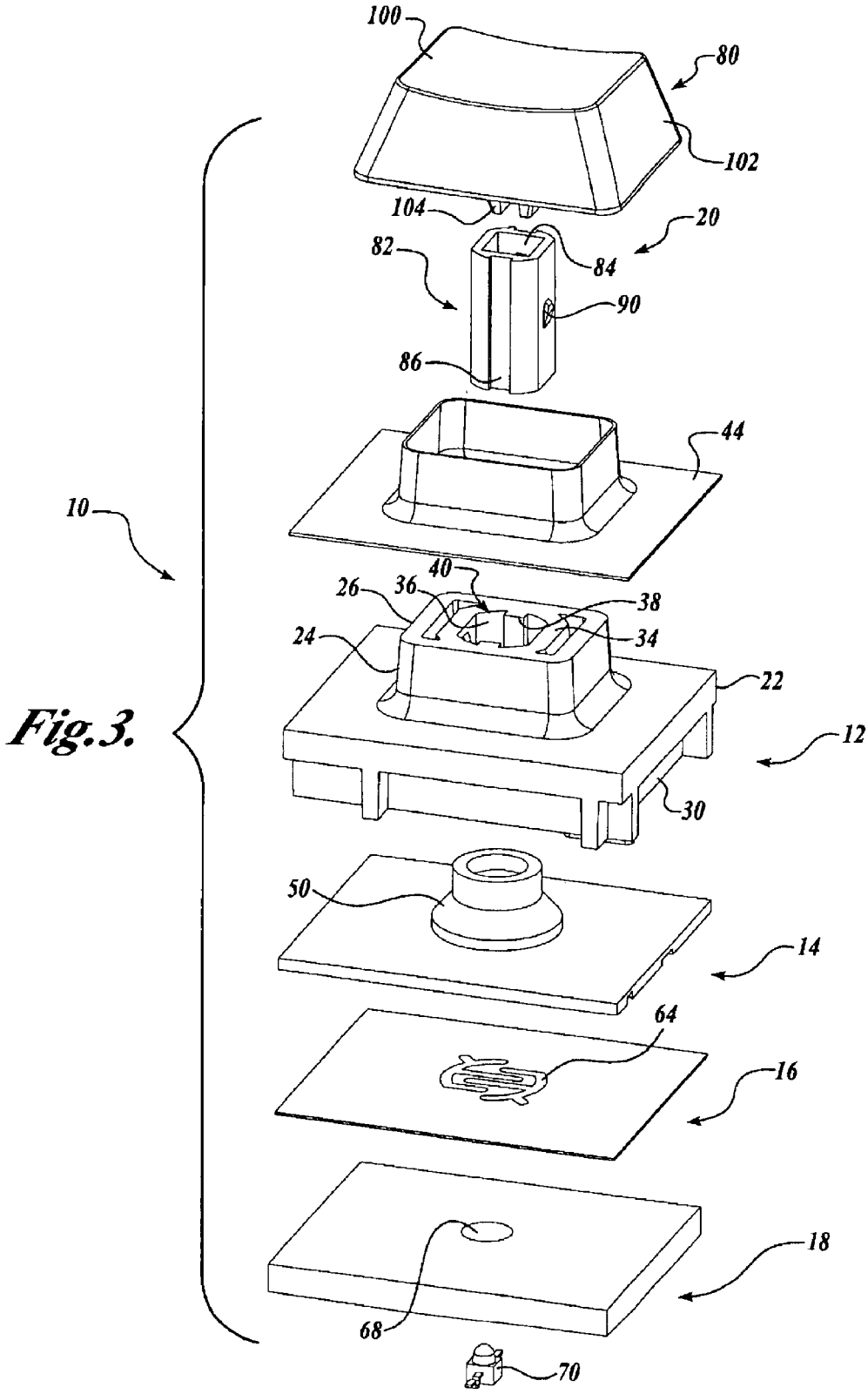
FIG. 3 illustrates an assembly view of the key assembly of FIG. 1.

Referring now to FIG. 3, each individual element of the key assembly 10 will be described in detail, beginning with the key support structure 12. The key support structure 12 is adapted to connect the movable key with the rest of the key assembly such that the movable key is axially moveably supported and guided when the movable key is pressed and released. In the embodiment shown, the key support structure is constructed in the form of a bezel housing that includes a base plate 22 having upwardly extending side walls 24, transverse to the base plate 22. The side walls 24 extend from the base plate 22 to form a hollow key silo 26. The base plate 22 further includes downwardly depending side walls 30, transverse to the base plate 22, which define a second cavity 32 (FIG. 4A) for accommodating the actuation pad 14, as will be described in more detail below.

Mounted in the hollow key silo 26 and connected to its side walls is an inner elongate member 34 of generally cylindrical geometry. In the embodiment shown, the elongate member 34 extends from the top of the key silo to approximately the lower portion of base plate 22. The elongate member 34 includes a longitudinally disposed bore 36 extending therethrough which forms a socket for receiving the moveable key 20 in sliding relation, as will be described in more detail below.

As best shown in FIG. 3, the elongate member 34 includes elongate ribs 38 disposed on diametrically opposed interior sides of the bore 36 and extending the entire length of the elongate member 34 to form a keyed upper opening 40. As will be described in more detail below, the elongate ribs 38 cooperate with longitudinally aligned slots on diametrically opposed sides of the plunger to form a guiding mechanism so that the movable key 20 is continuously aligned within the assembly, and prevented from rotating around the longitudinal axis of the assembly. The inner elongate member 34 further includes two recesses 42 (FIG. 4A) that extend inwardly from the other diametrically opposed interior sides of the bore 36. The recesses 42 are positioned adjacent to the upper opening of the bore 36 and function to engage protrusions 90 of the plunger. The recesses 42 and protrusions 90 cooperate to form a stop mechanism for retaining the moving key 20 within the key silo 26, thereby limiting the upward distance of travel the movable key may translate within the elongate member 34.

The key support structure 12 is of a unitary construction, preferably made from a transparent polycarbonate material. The key support structure 12 further includes an opaque layer overlaying the top surface of the base plate 22 and the key silo 26. As best shown in FIG. 3, the opaque layer is formed from a separate overlaying member 44 that overlays the base plate 22 and key silo 26. The overlaying member 44 includes an brilliant white inner surface and an opaque outer surface. Alternatively, the opaque layer may be any conventional coating, such as paint, applied to the key support structure in any conventional manner. When utilizing a coating as the opaque layer, a brilliant white underlying coating should first be applied to the key support structure. In either case, the opaque layer prevents light from transmitting through the top of the base plate 22 and the outer surfaces of the key silo 26, respectively. As will be apparent by the backlighting feature of the present invention, the top surface of the key silo remains translucent so that light from the light source can pass therethrough.

Figure 4B:
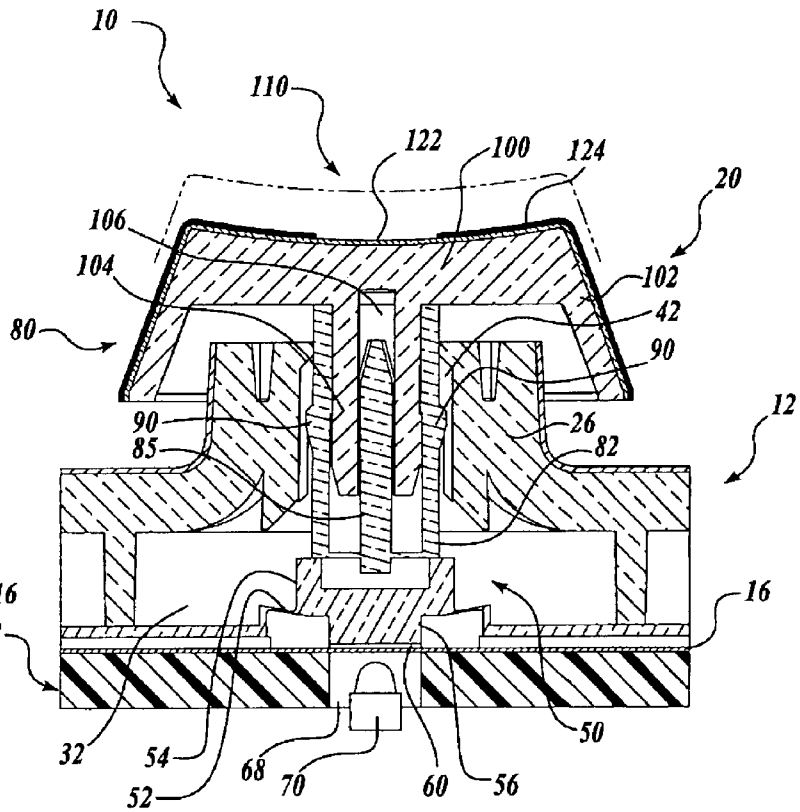
FIG. 4B illustrates a cross-sectional view of the key assembly of FIG. 1 in a depressed position.
Figure 4A:
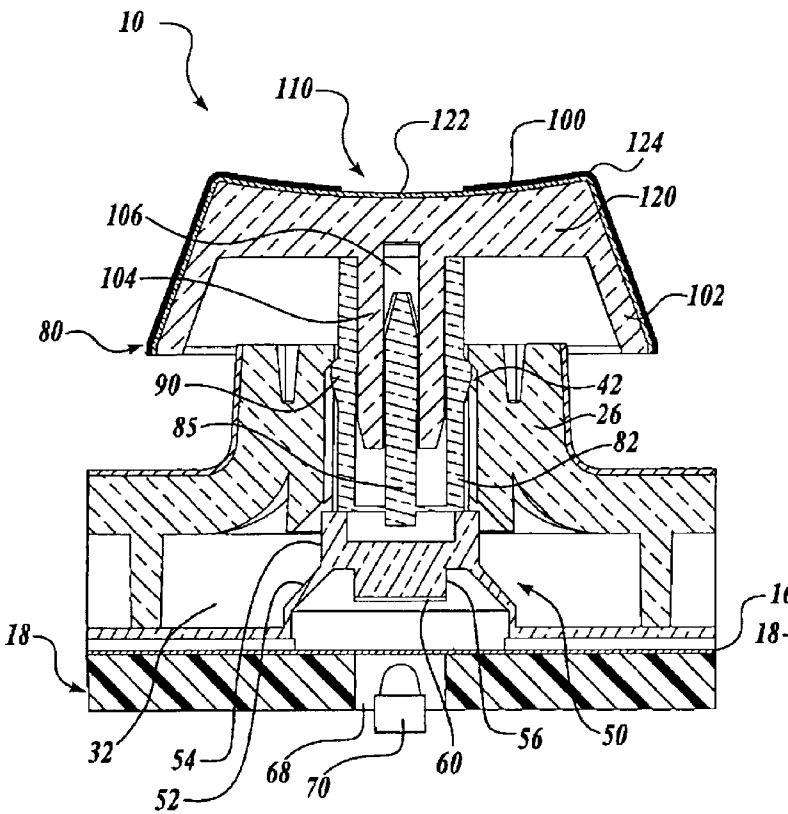
FIG. 4A illustrates a cross-sectional view of the key assembly of FIG. 1 in a non-depressed or at-rest position.

As best shown in FIGS. 3 and 4A, a translucent actuation layer 14 constructed out of an elastomeric material, such as silicon rubber, is disposed directly below key support structure 12 and substantially parallel to the base plate 22. The actuation layer 14 is of a unitary construction integrally formed with a depressible dome 50, the dome being associated with the moveable key 20. In the embodiment shown, the depressible dome 50 is generally circular in cross-section and of a suitable size such that the dome 50 provides a generally uniform upward force and uniform support for its associated movable key 20 across the entire bottom surface of the key 20.

As best shown in FIGS. 4A and 4B, the depressible dome 50 includes a flexible web 52, an upper support ring 54, and a projection portion 56. The upper support ring 54 extends around the entire perimeter of the depressible dome 50 and supports the bottom surface of the moveable key 20. When key 20 is depressed, the bottom surface of the key presses downwardly, equally and symmetrically on the depressible dome 50 so that the dome 50 flexes or deforms downwardly and uniformly around its entire cross-section. The projection portion 56 is integral with the upper support ring 54 and extends in a downward direction toward the switch layer 16. The projection portion 56 contains an electrically conductive surface 60 mounted to its bottom surface, facing the switch layer 16.

In the embodiment shown, the electrically conductive surface 60 is a unitary member extending the entire width of the projection portion 56. Alternatively, the surface 60 can be made up of a plurality of smaller dimensioned contacts disposed around the perimeter of the bottom surface of projection portion 56. In either case, the conductive surface 60 is opaque and preferably made from a carbon material to prevent corrosion, such as a conventional carbon contact puck. However, other materials may be used to provide an electrically conductive contact. In operation, the conductive surface 60 contacts an associated electrical contact on the switch layer 16 when the depressible dome 50 is sufficiently depressed by the movable key to produce the desired switching effect, as will be described in more detail below.

Referring back to FIG. 3, the key assembly 10 further includes a switch layer 16 and a base 18, both of which are parallel to and disposed directly below the actuation pad 14. The switch layer 16 is preferably made from a conventional transparent plastic sheet material or membrane that is mounted between the base 18 and the actuation pad 14. Mounted on the switch layer 16, in direct or overlapping alignment below the conductive surface 60 of actuation pad 14, is an electrical contact, such as switch pad 64. Similar to conductive surface 60, the switch pad 64 can be carbon coated to prevent corrosion, and can be formed by any conventional method, such as a copper cladding process or a printed silver ink process. Alternatively, the switch pad 64 may be a normally open circuit, such that when conductive surface 60 is depressed into contact with the open circuit, the circuit is closed. In either case, the conductive surface 60 and the switch pad 64 cooperatively form the switch of the key assembly 10, the switch operable to generate a signal. In the embodiment shown, the circuitry for the backlight functionality may be located on the base, while the circuitry for the switch can be located elsewhere in the assembly. Alternatively, the base 18, such as a circuit board, may contain all of the electronic circuitry necessary for both the switch and backlight functionality.

As best shown in FIGS. 3 and 4A–4B, the base 18 includes a centrally located aperture 68, which extends entirely through the base 18. The aperture 68 is positioned to be in substantial alignment with the conductive surface 60 and the switch pad 64. In the embodiment shown, the aperture is concentric with the depressible dome 50 and the key silo 26. Mounted to the underside of the base 18 is a light source 70, such as a light emitting diode (LED). The light source 70 protrudes upwardly through the aperture 68 to provide the illumination necessary to backlight the moveable key 20. Specifically, light radiates from the light source 70 and penetrates through the switch layer 16. Although the switch pad 64 partially occludes the switch layer 16, the light radiating from the light source passes through all of the transparent and translucent members of the key assembly to illuminate the key cap of the moveable key 20, as will be described in more detail below. Intensely illuminated areas and non-uniform illumination on the movable key 20, i.e. hot spots, normally created by the intense light of the light source are inhibited by the blocking and reflection action of the opaque conductive surface 60, which also provides a uniform backlit appearance on the moveable key. One skilled in the art will appreciate that the switch pad 64 also aids in the elimination of hot spots and the creation of a uniform backlit appearance.

Figure 5:
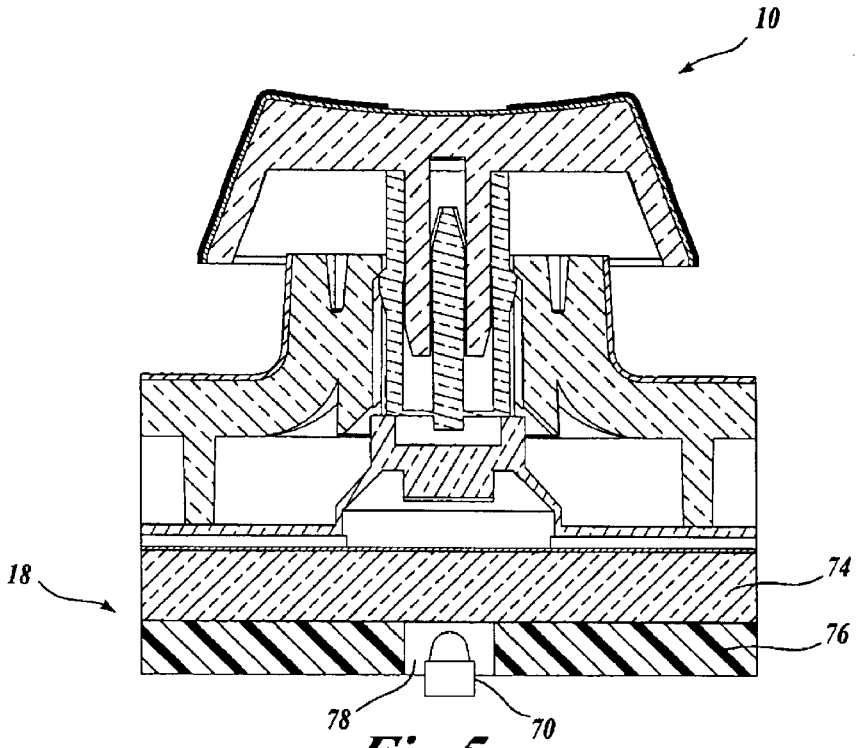
FIG. 5 illustrates a cross-sectional view of an alternative embodiment of a key assembly in accordance with the present invention.

In one embodiment, the base 18 of the key assembly 10 includes a spacer 74 and a base layer, such as circuit board 76, as best shown in FIG. 5. The circuit board 76 includes a centrally disposed aperture 78 to accommodate the light source 70 mounted to the circuit board 76. The spacer 74 is disposed between the switch layer 16 and the circuit board 76 to enhance the light output from the light source 70. The spacer 74 is translucent and preferably made from a clear plate-like acrylic. However, it will be appreciated that other materials may be used to form the spacer 74. The spacer 74 allows for the diffusion of the light from the light source 70 before it contacts the contact surface 64 (FIG. 3). Accordingly, the circuit board 76 may be mounted at various distances from the spacer 74 so that the light source, such as LEDs of various geometry and heights, can be employed in the key assembly 10. In another embodiment (not shown), the light source 70 may be mounted on the top of the circuit board 76 at a central location. In this embodiment, the aperture 78 is omitted, and an aperture is disposed within the spacer 74 to receive the light source 70. One skilled in the art will appreciate that the spacer 74 can have a suitable thickness to accommodate the height of the light source 70, but to not interfere with the switch layer.

Referring back to FIGS. 3 and 4A–4B, the key assembly 10 further includes an actuating member in the form of a moveable key 20 for actuating the switch of the key assembly 10. In the embodiment shown, the moveable key 20 comprises a key cap 80 and a longitudinally extending hollow plunger 82. The movable key 20 is slideably coupled to the key support structure 12 by the sliding engagement between the plunger 82 and the inner elongate member 34, the plunger 82 having its bottom end in engagement with the upper support ring 54 of the depressible dome 50. As assembled, when an external downward force is applied to the top of the key 20, the key 20 translates in sliding relation with respect to the key silo 26 to depress the depressible dome 50.

The plunger 82 is constructed of a translucent material and formed into a substantially cylindrical shape having a bore 84 that extends longitudinally therethrough. The plunger 82 includes a stem portion 85 that is connected to the plunger 82 at its lower end. The stem portion 85 is centrally located within the bore 84 of the plunger 82, and extends upwardly therein to engage with a portion of the moveable key 20, as will be described in more detail below. The plunger 82 also includes longitudinally aligned slots 86 disposed on diametrically opposed sides to form a cross-section that corresponds with the keyed opening 40 of the inner elongate members 34. The slots 86 cooperate with the vertically aligned elongate ribs 38 to form a guiding mechanism so that the movable key 20 is continuously aligned with the dome 50, and prevented from rotating around the longitudinal axis of the assembly. The plunger 82 further includes protrusions 90 that extend outwardly from the other diametrically opposed sides of the plunger 82. The protrusions 90 are positioned at approximately the midpoint of the opposed sides of the plunger and function to engage the recesses 42. The protrusions 90 cooperate with the recesses 42 of the inner elongate member to form the stop mechanism briefly described above.

As best shown in FIGS. 3, 4A and 4B, the movable key 20 further includes a key cap 80 having a main body 100 and an opaque skirt 102. The key cap 80 is selectively coupled to the plunger 82 in a force fit relation via a downward extending portion 104. The downward extending portion 104 is formed by two legs, which are suitably dimensioned and spaced to be received within the bore of the plunger 82. The portion 104 creates a centrally located, longitudinally extending bore 106 that forms a socket suitably dimensioned to receive the stem 85 of the plunger 82. As assembled, the downward extending portion 104 extends downwardly within the bore of the plunger 82 so that the stem portion 85 of the plunger 82 is received by the socket. The downward extending portion 104 is connected at about the center of the main body 100 to form an integral key cap 80.

While the moveable key 20 is described above and illustrated herein includes two separable parts, the plunger 82 and the key cap 80, it will be readily evident that the plunger and key cap of the movable key 20 may be integrally formed as a unitary member.

Referring now to FIG. 4A, a translucent region in the form of an indicator 110 is located on the top surface of the main body 100. The indicator 110 may be in the form of graphic symbols or alphanumeric characters, to name a few. In one embodiment, the translucent region is approximately centered on the top surface of the main body 100, in substantial alignment with the light source 70. Typically, since regions of the top surface of the key cap are light transparent, the indicator 110 is formed by rendering opaque the areas around the number or letter to define the letter or number. In this manner, as light from the light source transmits through the top surface, only the number or letter is visible since the remainder of the top surface is opaque. To render the area of the top surface opaque, a coating is painted or otherwise applied to the top surface to define the indicator 110. However, it is to be understood that other known techniques for forming the indicator may be used, such as a paper or plastic mask secured to the top surface and outlining the numbers or letters. Also, opaque indicators may be applied, which become visible when light from the light source shines through the surrounding clear regions of the top surface.

One method of constructing the key cap 80 with an indicator 110 in accordance with the present invention will now be described with reference to FIGS. 4A and 4B. The key cap 80 may be molded or otherwise formed from a transparent plastic core 120 and includes a first layer 122 which surrounds the core 120. The first layer 122 is translucent white and is coated, painted, or otherwise affixed to the plastic core 120 by any method known in the art. An opaque second layer 124 is then coated, painted, or otherwise affixed in overlaying relation to the first layer 122. The indicator 110 may then be formed on the top surface of the key cap 80 by a laser-etching process. The laser-etching process removes a portion of the opaque second layer 124 to reveal the first translucent layer 122 in the shape of the indicator 110 so that light may transmit through the plastic core 120 and the first translucent layer 122. Since the indicator 110 is formed by a laser etching process, the key assembly may be completely assembled and disposed within a functioning keyboard, key pad, or the like, prior to the indicator being etched. Accordingly, this allows all the key caps 80 of the key assemblies 10 in the keyboard to be etched during the same etching process.

The operation of the key assembly 10 constructed in accordance with aspects of the present invention will now be described with reference to FIGS. 1–4B. As the key cap 80 is depressed by axial force from its first or at-rest position (FIG. 4A), the plunger 82 translates downward into the depressible dome 50 due to its sliding engagement within the key silo 26. Due to the slots 86 and elongate ribs 38, the movable key 20 is prevented from rotating while the key 20 is guided downwardly against the depressible dome 50. As the key 20 continues to translate downward, the web 52 of the depressible dome 50 deforms, allowing the projection portion 56 to travel downwardly toward the base 18 in a uniform manner. The projection portion 56 continues to travel downwardly until electrically conductive surface 60 strikes the switch pad 64 of the switch layer 16. As best shown in FIG. 4B, the key 20 is at its second or depressed position when the electrically conductive surface 60 contacts the switch pad 64, causing a circuit to close, thereby operating the switch. Upon removal of the downwardly directed force on key cap 80, the natural resiliency of the web 52 causes the upper portion of the dome 50 to rise upwardly until web 52 returns to its original or at-rest configuration. As the dome 50 forces the moveable key 20 upwards, the length of travel of the moveable key 20 is limited due to the stop mechanism formed by the recesses 42 and protrusions 90, which engage each other when the moveable key 20 is at its non-depressed or at-rest position.

When the moveable key 20 is in its at-rest position, light from the light source 70 will be efficiently and uniformly dispersed through the key assembly 10 to backlight the alpha-numeric indicator 110, as will now be described in detail. Light emitting from the light source 70 transmits through transparent switch layer 16. As the light passes through the switch layer 16, the light is partially deflected by the switch pad 64. The remaining portion of the light enters and penetrates through the translucent actuation layer 14 and into the lower surfaces of the key silo 26 and plunger 82. Due to the location of the conductive surface 60, being in substantial alignment with the light source 70, the conductive surface 60 blocks the direct light from the light source, which may cause hot spots in the key cap 80. Blocking the light from above the light source 70 further provides a uniform backlit appearance at the indicator 110 of the key cap 80. Light received by the lower surface of the key silo 26 and plunger 82 transmits upwardly through the top surfaces thereof, which in turn, transmits through the key cap 80 to illuminate the indicator 110 of the key 20.

A key assembly 10 constructed in accordance with the present invention provides many advantages over the prior art. First, by locating the light source in alignment with the translucent region of the key, a single light source is needed to backlight the key. This lowers the energy consumption of the key assembly. Additionally, by locating the light source below the conductive surfaces of the switch, the conductive surfaces block the direct light radiating from the light source. This reduces intensely illuminated areas and non-uniform illumination, i.e., hot spots, while further providing a uniform backlit appearance.

Figure 6:
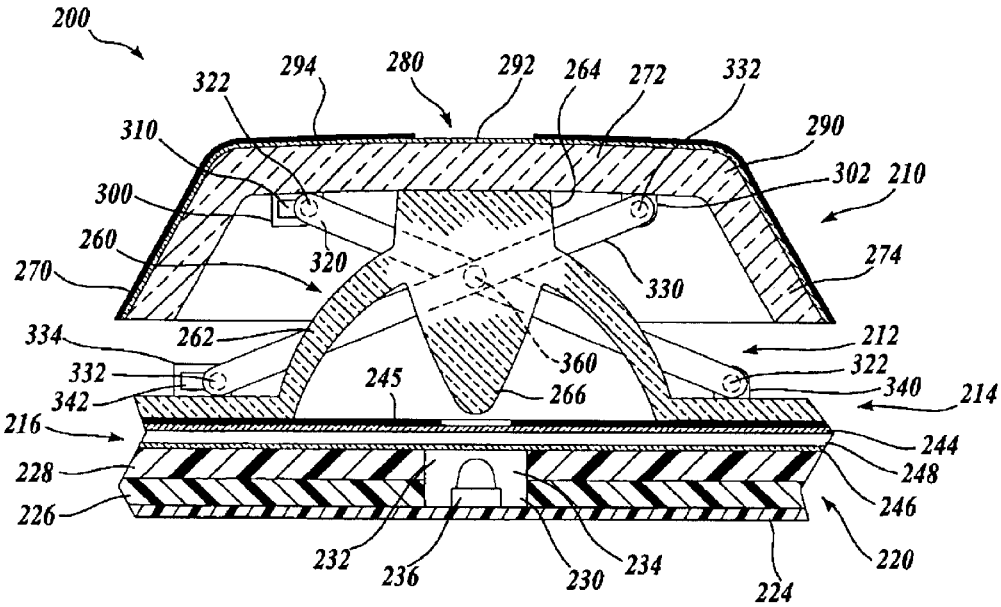
FIG. 6 illustrates a cross-sectional view of another alternative embodiment of a key assembly in accordance with the present invention.

An alternative embodiment of the key assembly is shown in FIG. 6. The key assembly 200 includes a moveable key 210, a key support structure 212, an actuation layer 214, a membrane switch assembly 216, and a base 220. A light source, such as an LED, is included in the key assembly 200 to provide a illumination for backlighting a translucent region on the moveable key 210. In operation, when force is exerted against the moveable key 210, the moveable key 210 axially translates against the actuation layer 214, which in turn, depresses the actuation layer 214 into engagement with the membrane switch assembly, thereby operating a switch. During axial translation of the moveable key 210, the key support structure 212 supports the movable key and maintains the top of the key perpendicular with the longitudinal axis of the assembly 200. Once force is relieved from the moveable key 210, the actuation layer returns the moveable key 210 to the first or non-depressed position shown in FIG. 6.

Each individual element of the key assembly 200 will now be described in detail, beginning with the base 220. The base 220 includes in a stacked configuration a membrane circuit layer 224, a spacer 226, and a base layer 228, the spacer being disposed between the membrane circuit layer 224 and the base layer 228. The spacer 226 and the base layer 228 can be constructed of various materials including plastics, metals, or combinations thereof. The spacer 226 includes a centrally located aperture 230. The base layer 228 includes an aperture 232 that is aligned with spacer aperture 230 to form a continuous longitudinal slot 234. A light source 236, such as an LED, is mounted to the surface of the membrane circuit layer 224, the light source extending within the slot 234 formed by spacer 226 and base layer 228. While spacer 226 and base layer 228 are shown as separate layers, it will be appreciated by those skilled in the art that spacer 226 and base layer 228 may be integrally formed as a single layer.

On the topside of the base layer 228, there are formed a first pair of projections 334 and a second pair of projections 340 that project upward from the top surface of the base layer 228. These projections are integrally molded with the base layer, or bonded thereto by an adhesive or solder depending of the material of the base layer 228. The first pair of projections 334 are formed with elongated slots 342 for slideably receiving pins formed at the lower ends of the key support structure 214, as will be described in more detail below. The second pair of projections 340 are formed with round apertures (not shown) for receiving pins formed at the lower ends of the key support structure 214, as will be described in more detail below. The first and second pairs of projections extend through apertures (not shown) in the actuation layer so as to be adjacent to the key support structure 214. Alternatively, the first and second pairs of projections 334 and 340 may be formed on the top surface of the actuation layer 212, facing the movable key and disposed adjacent to the key support structure 214.

Figure 7:
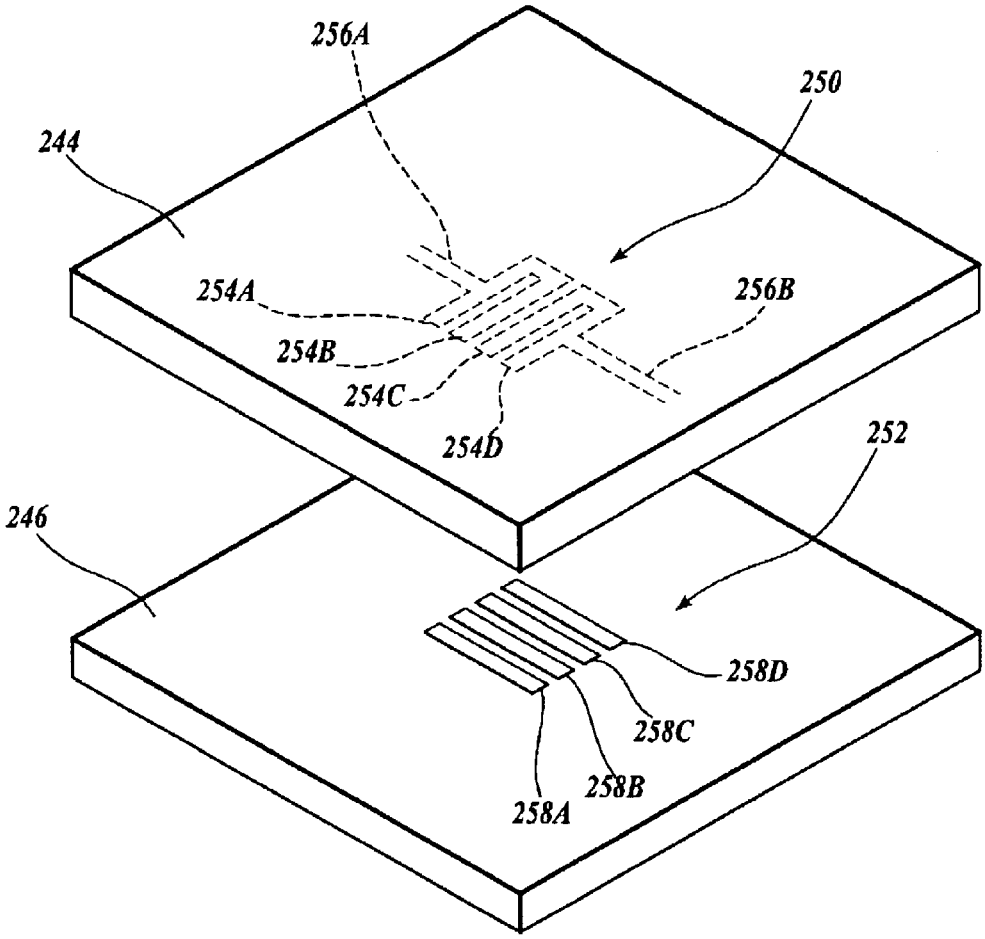
FIG. 7 illustrates a schematic representation of the upper and lower layers of the switch assembly shown in FIG. 6.

In the key assembly 200, the membrane switch assembly 216 overlays the base assembly 220. The membrane switch assembly 216 includes upper and lower switch layers 244 and 246 spaced apart and separated by an air gap 248. As best shown in FIG. 7, the bottom surface of the upper switch layer 244 includes an electrical contact 250 disposed in substantial alignment with the slot 234. The electrical contact 250 includes a plurality of elongate bars 254A–254D, the end bars 254A and 254D having leads 256A and 256B, respectively, connected thereto. Elongate bars 254A and 254B and elongate bars 254C and 254D are electrically connected by separate bridge sections. While not shown, it will be apparent to one skilled in the relevant art that the leads 256A and 256B are electrically connected to electrical circuitry operable to generate a signal when the circuitry is shorted.

The membrane switch assembly 216 may further include an opaque layer that overlays the top surface of the upper switch layer 244 to block stray light which emits from the light source. The opaque layer may be formed from a separate overlaying member or, alternatively, the opaque layer may be any conventional coating, such as paint, applied to the key support structure in any conventional manner.

The top surface of the lower switch layer 246 includes an electrical contact 252, which cooperates with the contact 250 to form the switch operable to generate a signal. The electrical contact 252 includes a plurality of elongate bars 258A–258D, that are disposed perpendicular to and in overlapping alignment with the upper switch layer electrical contact 250. The upper and lower switch layers 244 and 246 are constructed of a transparent material so that light from the light source 236 can penetrate through. The top surface of the upper switch layer 244 may include an opaque or black layer 245 except in the general area of the electrical contacts 250, the layer 245 operable to prevent light bleed between an aggregate of key assemblies 200. In operation, when the projection portion of the actuation layer is forced into contact with the flexible upper layer 244, directly above the electrical contact 250, the upper switch layer 244 depresses axially until contact is made with the lower switch layer 246. When upper switch layer 244 contacts lower switch layer 246, bars 254A–254D of electrical contact 250 contact bars 258A–258D of electrical contact 252 to short the circuit.

Still referring to FIG. 6, adjacent to the top surface of the upper switch layer 244 of switch assembly 216 is the actuation layer 214. The actuation layer 214 is translucent and preferably constructed from an elastomeric material, such as silicon rubber. The actuation layer 214 is of a unitary construction integrally formed with a depressible dome 260, the dome being associated with the moveable key 210, as will be described in more detail below. The depressible dome 260 is generally circular in cross-section and of a suitable size such that the dome 260 provides a generally uniform upward force and uniform support for its associated moveable key 210.

As best shown in FIG. 6, the depressible dome 260 includes a flexible web 262, an upper support ring 264, and a projection portion 266. The upper support ring 264 supports the lower surface of the moveable key 210. When movable key 210 is depressed, the lower surface of the key 210 presses downwardly, equally and symmetrically on the depressible dome 260 so that the dome 260 flexes or deforms downwardly and uniformly around its entire cross-section. The projection portion 266 is integral with the upper support ring 264 and disposed in substantial alignment with the electrical contacts 250 and 252 of switch assembly 216. The projection portion 266 extends in a downward direction to a position just proximal the upper switch layer 244. As will be described in more detail below, the projection portion 266 operates as a an actuator for actuating the switch of the key assembly 200.

The key assembly 200 further includes a moveable key 210. In the embodiment shown, the moveable key 210 defines a key cap 270 having a translucent main body 272 and an opaque skirt 274. The key cap 270 rests upon the depressible dome 260 of the actuation layer such that as assembled, when an external downward force is applied to the top of the moveable key 210, the key translates axially to depress the depressible dome 260.

Describing the moveable key 210 in more detail, a translucent region in the form of an indicator 280 is located on the top surface of the main body 272. The indicator 280 may be in the form of graphical symbols or alpha numeric characters, to name a few. In one embodiment, the indicator 280 is disposed in substantial alignment with the projection portion 266. As described above with reference to the other embodiments, the indicator 280 can be formed by rendering opaque the areas around the number or letter to define the letter or number. To render the area of the top surface opaque, a coating is painted or otherwise applied to the top surface to define the indicator. In the embodiment shown, the key cap 270 is molded or otherwise formed from a transparent plastic core 290 and includes a first layer which surrounds the core. The first layer 292 is translucent white and is coated, painted, or otherwise affixed to the plastic core 290 by any method known in the art. An opaque second layer 294 is then coated, painted, or otherwise affixed in overlaying relation to the first layer 292. An indicator, such as indicator 280, may then be formed on the top surface of the key cap 270 by a laser-etching process. The laser-etching process removes a portion of the opaque second layer 294 to reveal the first translucent layer 292 in the shape of the indicator 280 so that light may transmit through the plastic core 290 and the first translucent layer 292.

On the underside of the key cap 270, there are formed a first pair of projections 300 and a second pair of projections 302 that project downward from the inner surface of the key cap. These projections are integrally molded with the key, or bonded thereto by an adhesive. The first pair projections 300 are formed with elongated slots 310 for slideably receiving pins formed at the upper ends of the key support structure 214, as will be described in more detail below. The second pair of projections 302 are formed with round apertures (not shown) for receiving pins formed at the upper ends of the key support structure 214, as will be described in more detail below.

Still referring to FIG. 6, the key assembly 200 further includes the key support structure 214 which is adapted to connect the key cap 270 to the base 220 such that the key cap 270 is axially moveably supported and guided when the key cap is pressed and released. The key support structure 214 includes two pairs of linkage members, each pair of linkage members mutually pivotally connected to each other so as to intersect each other in the form of scissors or the letter (X). A pair of linkage members are found on either side of the depressible dome, although only one set of linkage members is illustrated in FIG. 6.

Each pair of linkage members includes a first linkage 320 and a second linkage 330 having general elongate bodies with pins 322 and 332 at their respective opposed ends. The pins 322 and 332 extend outwardly from the elongate bodies in a generally orthogonal manner to form substantially C-shaped members. The first linkage 320 of each pair of linkage members is slideably connected to the protrusions 300 of the key cap 270 and pivotally connected to the protrusions 340 of the base layer 228 via pins 322. The second linkage 330 of each pair of linkage members is pivotally connected to the protrusions 302 of the key cap 270 and slideably connected to the protrusions 334 of the base layer 228 via pins 332. The first and second linkages 320 and 330 are pivotally connected to one another at approximately the intermediate portion of both linkages via a fastener 360, such as a pin, rivet, or the like. Scissors-type key support structures similar to the one discussed above are know in the art, and will be not be described in any more detail.

The operation of the key assembly 200 constructed in accordance with aspects of the present invention will now be described with reference to FIG. 6. When the key cap 270 is depressed by axial force from its first or at-rest position, the web 262 of the depressible dome 260 deforms, allowing the projection portion 266 to travel downwardly toward the switch assembly 216 in a uniform manner. The projection portion 266 continues to travel downwardly until the electrical contact 250 contacts the electrical contact 252, which thereby shorts the circuit to operate the switch. Upon removal of the downwardly directed force on key cap 270, the natural resiliency of the web 262 causes the upper support ring 264 of the dome 260 to rise upwardly until web 262 returns to its original or at-rest configuration.

When the moveable key 210 is in its at-rest position, light from the light source 236 will be efficiently and uniformly dispersed through the key assembly to backlight the alpha-numeric indicator, as will now be described in detail. Light emitting from the light source 236 transmits through the transparent portion of the switch assembly 216. As the light passes through the switch assembly 216, the light is partially deflected by the electrical contacts 250 and 252. The remaining portion of the light penetrates through the switch assembly in-between the bars 254A–D and 258A–D, and into the projection portion 266. Due to locating the electrical contacts 250 and 252 in substantial alignment with the light source, the electrical contacts partially block the direct light from the light source 236, thereby preventing hot spots in the key cap 80. Partially blocking the light from above the light source 236 further provides a uniform backlit appearance at the translucent region of the key cap 270. Alternatively, a wide-angle light emitting diode (LED) may be used as the light source to prevent hot spots and to provide a more uniform appearance. Light received by the projection portion 266 transmits upwardly through the top surface of the depressible dome 260, which in turn, transmits through the key cap 270 to illuminate the alpha-numeric indicator 280 of the key 210.

A key assembly 200 constructed in accordance with the present invention provides many advantages over the prior art. First, by locating the light source in alignment with the translucent region of the key, a single light source is needed to backlight the key. This lowers the energy consumption of the key assembly 200. Additionally, by locating the light source below the electrical contacts of the switch, the electrical contacts partial block the direct light radiating from the light source 236. This reduces intensely illuminated areas and non-uniform illumination, i.e., hot spots, while further providing a uniform backlit appearance.

Figure 8:
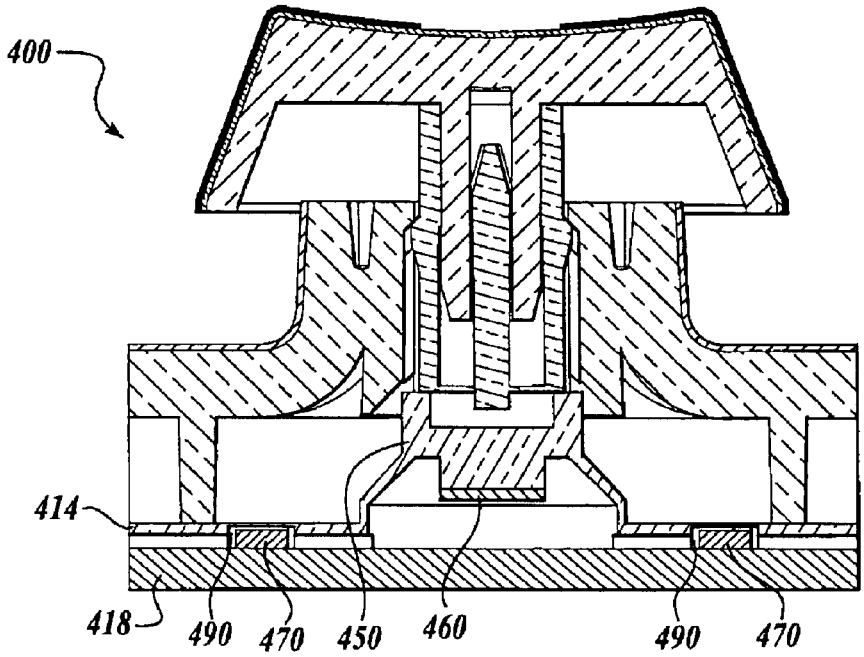
FIG. 8 illustrates a cross-sectional view of yet another alternative embodiment of a key assembly in accordance with the present invention.

FIG. 8 illustrates yet another embodiment of a key assembly 400 in accordance with the present invention. The key assembly 400 is substantially identical in construction, materials, and operation as key assembly 10 described above with respect to FIGS. 1–4B, except for the following differences which will now be described in detail. The key assembly 400 includes a base 418 on which a plurality of light sources are mounted, and an actuation layer 414. The actuation layer 414 includes a depressible dome 450 and cavities 490 disposed around the outer perimeter of the depressible dome 450. The cavities 490 open adjacent to the top surface of the base 418 and are adapted to receive the light sources 470. The depressible dome 450 includes an electrically conductive surface 460 mounted to its bottom surface, facing the top surface of the base 418. In this embodiment, the switch layer 16 of the key assembly 10 shown in FIGS. 1–4B is omitted. Instead, the base 418 includes an electrically conductive surface (not shown), such as a switch pad, positioned on the top surface of the base 418 directly below the electrically conductive surface 460. The electrically conductive surface of the base 418, along with the electrically conductive surface 460 of the actuation layer 414 form the switching function of the key assembly 400.

While the bases of the various embodiments described above and illustrated herein refer to the base as a circuit board or may include a circuit board, it will be apparent that the base may or may not have electrical circuitry connected to the light source. If the base does not contain electrical circuitry for the light source, one skilled in the relevant art will appreciate that the electrical circuitry may be located elsewhere, such as in the keyboard.

While the various embodiments of the invention have been illustrated and described, it will be appreciated that various changes can be made therein without departing from the spirit and scope of the invention.

The embodiments of the invention in which an exclusive property or privilege is claimed are defined as follows:

1. A backlit key assembly comprising:

a key having a light translucent region, said key axially movable along a longitudinal axis of said assembly;

a base;

a key support structure operably connected to said base, said key support structure operable to guide said key when said key is axially movable along said longitudinal axis of said assembly;

a switch operable to generate a signal corresponding to said axial movement of said key, said switch including an opaque member; and an illumination source mounted to said base in substantial alignment with said opaque member, said illumination source operable to provide light for backlighting said key assembly through said light translucent region.

2. The key assembly of claim 1, wherein said opaque member is an electrical contact.

3. The key assembly of claim 2, wherein said switch includes a movable layer and a fixed layer, and wherein said key includes an actuator to cause said movable layer to contact said fixed layer to operate said switch.

4. The key assembly of claim 3, wherein said electrical contact is disposed on said movable layer.

5. The key assembly of claim 3, wherein said movable layer is an actuation layer having a depressible member that extends outwardly from said actuation layer, said depressible member being aligned with said actuator of said key.

6. The key assembly of claim 5, wherein said electrical contact is disposed on said depressible member.

7. The key assembly of claim 3, wherein said actuator is an elongate member.

8. The key assembly of claim 7, wherein said elongate member is integrally formed with said key.

9. The key assembly of claim 2, wherein said switch includes a flexible layer and a fixed layer, said flexible layer separated from said fixed layer by a gap, and wherein said key assembly further includes an actuator to cause said flexible layer to contact said fixed layer, thereby operating said switch.

10. The key assembly of claim 9, wherein said actuator is a depressible member that engages said key and extends outwardly away from said key to just proximal said flexible layer.

11. The key assembly of claim 9, wherein said electrical contact is disposed on said flexible layer.

12. The key assembly of claim 1, wherein said key support structure includes a socket that slideably receives said movable key.

13. The key assembly of claim 1, wherein said base includes electrical circuitry for said illumination source.

14. The key assembly of claim 1, wherein said illumination source is a light emitting diode.

15. The key assembly of claim 1, wherein said key support structure includes a first linkage rotatably coupled to a second linkage.

16. The key assembly of claim 1, wherein said base includes a translucent or transparent member and a circuit board, said source of illumination mounted to said circuit board and said translucent or transparent member disposed between said switch and said circuit board.

17. The key assembly of claim 1, wherein said translucent region of said key is an alphanumeric indicator.

18. The key assembly of claim 17, wherein said alphanumeric indicator is formed from a laser-etching process.

19. A backlit key assembly comprising:

a key having a proximal surface and a distal surface with a translucent region, said key movable between a non-depressed position and a depressed position along a longitudinal axis of said key assembly;

a base;

a key support structure that supports said key between said non-depressed and depressed positions along said longitudinal axis of said key assembly;

a switch disposed adjacent to said base, said switch including an opaque portion being in substantial alignment with said translucent region, wherein said switch generates a signal when said key is moved proximally to said depressed position; and a light source associated with said base in substantial alignment with said opaque portion;

wherein said key assembly is operable to permit light from said light source to pass through said translucent region.

20. The key assembly of claim 19, wherein said opaque portion of said switch is an electrical contact.

21. The key assembly of claim 20, further comprising an actuation layer operable to maintain said key in said non-depressed position and further operable to return said key to said non-depressed position from said depressed position.

22. The key assembly of claim 21, wherein said actuation layer includes an actuator to operate said switch.

23. The key assembly of claim 21, wherein said switch includes an actuation layer having said electrical contact mounted thereon, and a switch layer having a second electrical contact disposed in overlapping alignment with said electrical contact such that said electrical contact contacts said second electrical contact when said key is in said depressed position.

24. The key assembly of claim 21, wherein said switch includes an upper layer having said electrical contact mounted thereon, and a lower layer having a second electrical contact disposed in overlapping alignment with said electrical contact such that said electrical contact contacts said second electrical contact when said key is in said depressed position.

25. The key assembly of claim 24, wherein said electrical contact includes a plurality of spaced-apart bars having ends, the ends of said spaced-apart bars in electrical communication with electrical leads.

26. The key assembly of claim 25, wherein said second electrical contact includes a plurality of spaced-apart bars disposed perpendicular to said spaced-apart bars of said electrical contact.

27. The key assembly of claim 20, wherein said switch including an actuation layer operable to maintain said key in said non-depressed position and further operable to return said key to said non-depressed position from said depressed position.

28. The key assembly of claim 27, wherein said electrical contact is disposed on said actuation layer.

29. The key assembly of claim 19, wherein said base includes a circuit board and a spacer, said spacer disposed between said switch and said circuit board.

30. The key assembly of claim 29, wherein said spacer is translucent or transparent.

31. A backlit key assembly comprising:

a key having a light translucent region, said key axially movable from a first position to a second position along a longitudinal axis of said assembly;

base means for operatively supporting said key;

key support means operably connected to said base layer, said key support means for guiding said key when said key is axially movable along said longitudinal axis of said assembly;

switch means for generating a signal corresponding to said axial movement of said key, said switch means including an opaque member; and illumination means for emitting light so as to backlight said key assembly through said light translucent region, said illumination means mounted in substantial alignment with said opaque member.

32. The key assembly of claim 31, wherein said key support means includes a socket for slideably receiving said key.

33. The key assembly of claim 31, wherein said key support means includes a first linkage pivotally coupled to a second linkage.

34. The key assembly of claim 31, wherein said base means includes a spacer and a circuit board.

35. The key assembly of claim 31, wherein said illumination means is a light emitting diode.

36. The key assembly of claim 31, wherein said switch means includes an actuation layer having a first electrical contact mounted thereon, and a switch layer having a second electrical contact disposed in overlapping alignment with said first electrical contact such that said first electrical contact contacts said second electrical contact when said key is in said second position.

37. The key assembly of claim 31, wherein said switch means includes an upper layer having a first electrical contact mounted thereon, and a lower layer having a second electrical contact disposed in overlapping alignment with said first electrical contact such that said first electrical contact contacts said second electrical contact when said key is in said second position.

38. In a backlit key assembly having a base, a switch layer disposed adjacent to said base and operable to generate a signal, a movable key having a translucent region and axially movable between a first and a second position, a key support structure that supports said key between said first and second positions, and a light source operable to backlight said translucent region, said improvement comprising:

wherein said switch includes an opaque member, and wherein said light source is coupled to said base in substantial alignment with said opaque member.

39. The improvement of claim 38, wherein said opaque member is an electrical contact.

40. A backlit key assembly comprising:

a key having a light translucent region, said key movable between a non-depressed position and a depressed position;

a circuit board;

a key support structure disposed between said key and said circuit board, said key support structure slideably receiving said key;

an actuation layer including a depressible member that extends outwardly from said actuation layer, said depressible member including a first electrical contact;

a switch layer disposed between said actuation layer and said circuit board, said switch layer including a second electrical contact in overlapping alignment with said first electrical contact, said switch layer having a key side and a circuit board side; and an illumination source disposed on said circuit board side of said switch layer in substantial alignment with said first and second electrical contacts, said illumination source operable to provide light for backlighting said key assembly through said light translucent region;

wherein said first electrical contact contacts said second electrical contact when said key is movable to said depressed position, thereby generating a signal.

41. The key assembly of claim 40, wherein said base includes an aperture in substantial alignment with said first and second contacts, said light source mounted through said aperture.

42. The key assembly of claim 41, wherein said aperture is concentric with a portion of said movable key.

43. The key assembly of claim 40, wherein said moveable key includes an elongate member having a protrusion portion, and wherein said key support structure having a protrusion portion, said protrusion portion of said elongate member engaging said protrusion portion of said key support structure in said non-depressed position.

44. The key assembly of claim 40, wherein said light translucent region of said key is an alphanumeric indicator.

45. The key assembly of claim 44, wherein said alphanumeric indicator is formed from a laser-etching process.

46. The key assembly of claim 40, further comprising a translucent or transparent member disposed between said switch layer and said circuit board.

47. A backlit key assembly comprising:

a key having a top surface with a light translucent region, said key movable between a first and a second position when an axial force is exerted on said top surface;

a base;

a key support structure operably connected to said base, said key support structure operable to support said key between said first and second positions;

a switch disposed adjacent to said base and operable to generate a signal when said key is in said second position, said switch including an electrical contact and having a base side and a key side;

a light source disposed on said base side of said switch in substantial alignment with said electrical contact; and a depressible member disposed adjacent to said switch, wherein said depressible member maintains said key in said first position when said axial force is not exerted on said top surface of said key, and returns said key to said first position from said second position when said force is removed from said top surface of said key.

48. A backlit key assembly comprising:

a key having a light translucent region, said key movable between a non-depressed position and a depressed position along a longitudinal axis of said assembly;

a base;

a key support structure disposed between said key and said base, wherein said key support structure supports said key between said non-depressed and depressed positions;

a switch overlaying said base and operable to generate a signal, said switch including an electrical contact;

an actuator disposed adjacent to said key and extending parallel to said longitudinal axis; said actuator operable to engage said switch when said key is in said depressed position; and an illumination source disposed in substantial alignment with said electrical contact, wherein said illumination source provides light for backlighting said key assembly through said light translucent region.

* * * * *

UNITED STATES PATENT AND TRADEMARK OFFICE

CERTIFICATE OF CORRECTION

PATENT NO. : 6,743,993 B1
DATED : June 1, 2004
INVENTOR(S) : J.T. Clark et al.

It is certified that error appears in the above-identified patent and that said Letters Patent is hereby corrected as shown below:

Title page,
Item [73], Assignee, "C'oeur" should read -- Coeur --.

Column 15,
Lines 4, "including an actuation" should read -- includes an actuation --.

Column 16,
Line 34, "moveable" should read -- movable --.

Signed and Sealed this

Eleventh Day of April, 2006

JON W. DUDAS
*Director of the United States Patent and Trademark Office*